United States Patent [19]

Burns

[11] 4,299,008

[45] Nov. 10, 1981

[54] CURTAIN RAIL

[76] Inventor: Bernard Burns, 1448 Paisley Rd. West, Glasgow G52 1SS, Scotland

[21] Appl. No.: 70,715

[22] Filed: Aug. 29, 1979

[30] Foreign Application Priority Data

Aug. 31, 1978 [GB] United Kingdom ..... 35130/78

[51] Int. Cl.[3] ..... A47H 1/06

[52] U.S. Cl. ..... 16/95 D

[58] Field of Search ..... 16/95 D, 95 R, 96 R, 16/96 D, 94 D, 93 D, 87.4 R

[56] References Cited

U.S. PATENT DOCUMENTS

| | | | |
|---|---|---|---|
| 2,736,055 | 2/1956 | Bell | 16/95 D |
| 3,206,791 | 9/1965 | Weber | 16/96 D |

FOREIGN PATENT DOCUMENTS

| | | | |
|---|---|---|---|
| 1136802 | 9/1962 | Fed. Rep. of Germany | 16/94 D |
| 1142054 | 1/1963 | Fed. Rep. of Germany | 16/93 D |
| 1223514 | 8/1966 | Fed. Rep. of Germany | 16/93 D |
| 398039 | 2/1966 | Switzerland | 16/95 D |
| 530608 | 12/1940 | United Kingdom . | |
| 884891 | 12/1961 | United Kingdom | 16/96 D |
| 896118 | 5/1962 | United Kingdom . | |
| 1246291 | 9/1971 | United Kingdom . | |
| 1259334 | 1/1972 | United Kingdom . | |

*Primary Examiner*—James Kee Chi

*Attorney, Agent, or Firm*—Spencer & Kaye

[57] ABSTRACT

A curtain rail consists of a number of interconnected lengths of extruded aluminium support rail of inverted channel section with inwardly projecting ribs at the mouth of the channel section. In the installed curtain rail, the ribs are embraced by one-piece or continuous plastics glide tracks engaged by necked nylon runners. The cross-sectional configurations of the ribs and the tracks are mutually complementary so that the tracks can be press-fitted manually and are self-retaining. The preferred track is a P.V.C. extrusion of C-shaped section. The arrangement provides, conveniently and economically, the advantage of easy handling and transporting associated with multi-piece support rail, coupled with the advantage of quiet click-free operation.

6 Claims, 4 Drawing Figures

CURTAIN RAIL

This invention relates to a curtain rail.

Whereas a one-piece or continuous curtain rail made from appropriately long length of rail stock, for example aluminium extrusion, advantageously does not give rise to problems with curtain-suspending runners jamming or causing objectionable clicking noise at rail joints, the use of shorter rail lengths and separate corner or bend units is advantageous from the point of view of ease of storing, handling, packaging and transporting particularly in the case where curtain rail systems are factory made to specific order and then transported, perhaps some considerable distance, to the desired point of installation.

An object of the present invention is to provide a curtain rail having both of the advantages mentioned above and which is economic to manufacture and easy and convenient to install and maintain.

According to the present invention, there is provided a curtain rail comprising an assembly of a plurality of lengths of support rail, part of the cross-sectional configuration of each said length defining a pair of mutually parallel and mutually spaced longitudinal ribs which project laterally inwards of the support rail, and a pair of one-piece plastics glide tracks of a resiliently yieldable material each embracing a respective one of said ribs and each extending on all of the said lengths of said assembly so as to bridge all interlength joints, the cross-sectional configurations of the ribs and tracks being generally mutually complementary and the tracks being fitted to the assembly by press-fitting manually and self-retaining on the ribs.

Embodiments of the present invention will now be described, by way of example, with reference to the accompanying drawings in which.

Figure 1:
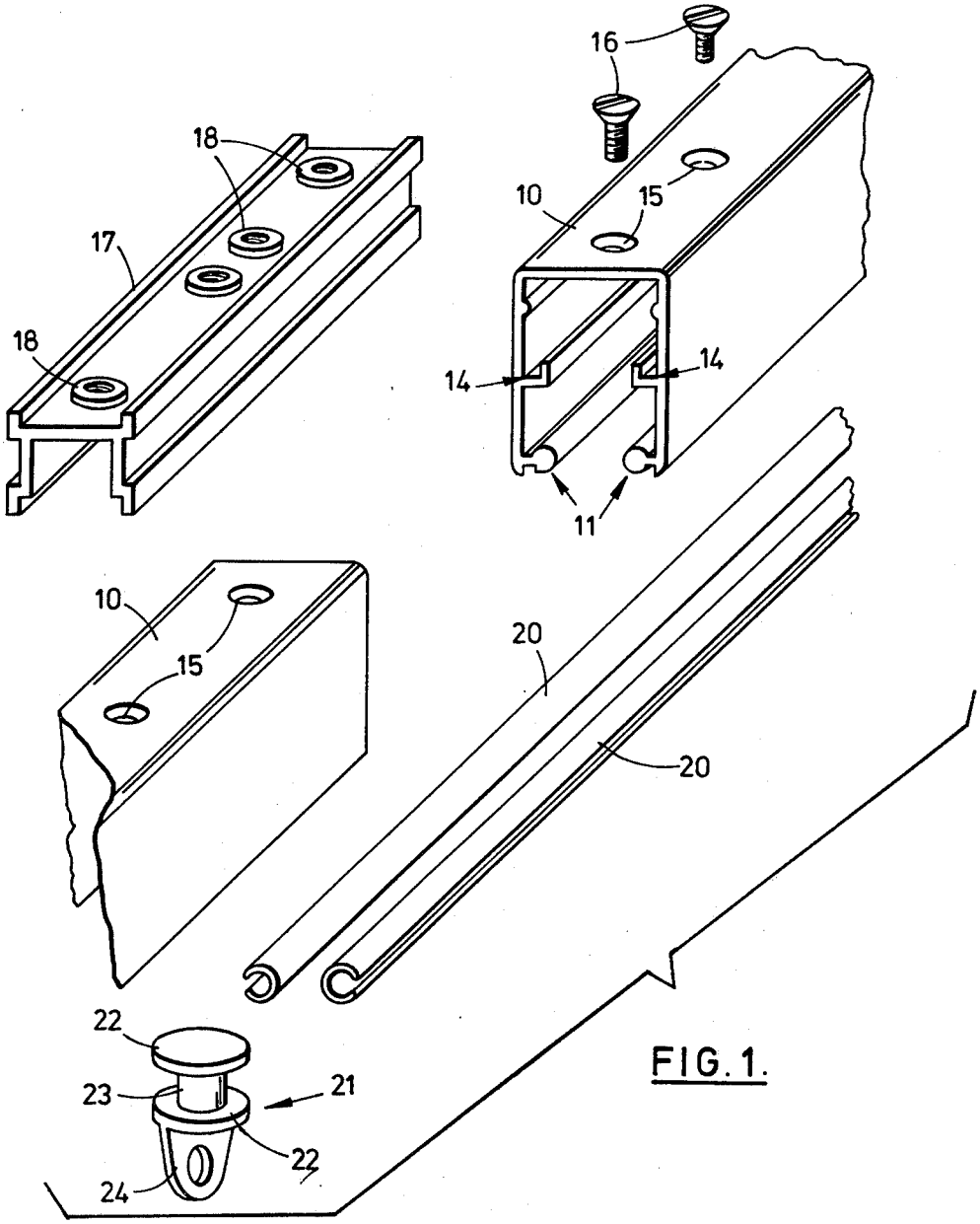
FIG. 1 is an exploded perspective view of part of a curtain rail in accordance with the present invention.
Figure 2:
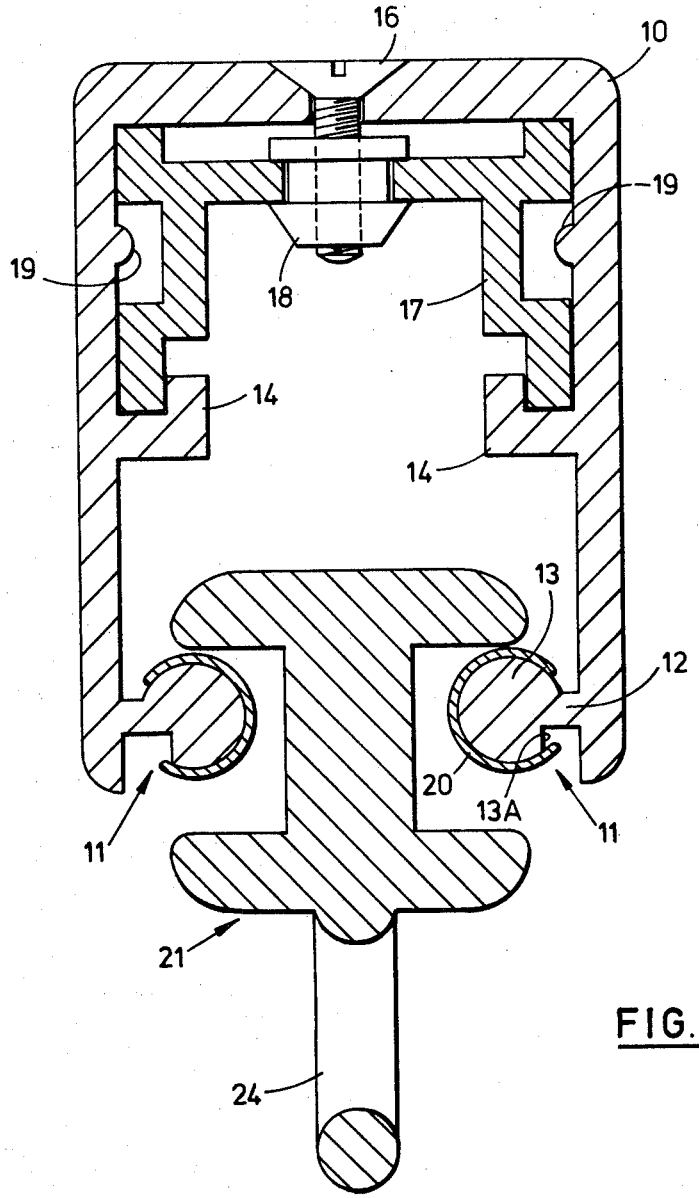
FIG. 2 is a sectional end elevation of the curtain rail of FIG. 1 to a larger scale than FIG. 1.

In FIGS. 1 and 2 of the drawings, an installed curtain rail comprises an assembly of a plurality of lengths of support rail 10 two of which lengths are shown in FIG. 1. The support rails 10 are made of aluminium by a known extrusion process by means of which the desired cross sectional configuration is readily attainable. The cross sectional configuration of the rail 10 is generally of channel section having a web-to-flange ratio of approximately 2:3. Adjacent the mouth of the channel section, which is presented downwardly in the installed curtain rail, part of the cross-sectional configuration of the rail 10 defines a pair of ribs 11 which project laterally inwards of the support rail 10. Each rib 11 consists of a web portion 12 integral with the adjacent flange of the support rail 10 and a bead 13 of circular cross section recessed as shown at 13A in FIG. 2 for the purpose hereinafter explained. Another part of the cross sectional configuration of each support rail 10 defines a pair of lipped ledges 14. The end portion of each length of support rail 10 is provided with longitudinally spaced countersunk holes 15 for receiving fixing screws 16.

The lengths of support rail 10 are interconnected by means of extruded aluminium connectors 17 one of which can be seen in FIGS. 1 and 2. The connectors 17 can be inserted in the support rails 10 wherein they fit snugly with their lower edge portions received within the lipped ledges 14 as can be seen in FIG. 2. Each connector 17 is provided with screw-threaded plastics inserts 18 for engagement by the fixing screws 16 to lock the support rails 10 to the connector 17. The top side of the connector 17 is recessed to accommodate the thickness of the upper flanges of the screwthreaded inserts 18; and the lateral side faces of the connectors 17 are recessed to clear small beads 19 forming another part of the cross-sectional configuration of the support rails 10. The small beads 19 are provided for the purpose of reducing the internal lateral dimension of the support rails 10 to match the corresponding dimension of a standard item (not shown) associated with the suspension of the curtain rail assembly. Such suspension is not a feature of the present invention.

Each complete curtain rail has one pair of glide tracks 20. Each glide track 20 is made of polyvinylchloride, which, as is well known, is a resiliently yieldable material. Each glide track has a polished external surface and is of C shaped cross-sectional configuration generally complementary with that of the ribs 11. In the installed curtain rail, the glide tracks 20 embrace respective ones of the ribs 11, and each glide track 20 is one-piece or continuous so that the glide tracks extend on all of the lengths of support rail 10 in the assembly and so bridge all inter-length joints or gaps.

Curtains are suspended from the above described curtain rail by means of runners 21 one of which is shown in FIGS. 1 and 2. The runners 21 are moulded from nylon and comprise upper and lower flange portions 22 which are interconnected by a neck 23. The lower flange portion 22 incorporates an apertured lug 24 for receiving a curtain hook.

The manner of installation and operation of the curtain rail described above is generally as follows. The entire curtaining system envisaged, for example a curtain track system for providing individual curtain screening in an open hospital ward, is designed to use a plurality of lengths of support rail 10, which may include straight lengths and bends, which are limited in maximum length to that which is convenient for packing and transporting purposes. Bends or curves are formed from stock support rail material using known techniques for the bending or curving of hollow sections. The interconnecting or joining of the lengths of support rail 10 to form an assembly defining a complete support rail is effected using the connectors 17 as has been described above. The assembled support rail is suspended or fixed in position by known means (not shown) not constituting a feature of the present invention. When the plurality of support rail lengths have been assembled to form a complete support rail, the glide tracks are cut from stock material each to a length sufficient to extend along all of the support rail lengths so as to provide a pair of continuous or one-piece glide tracks. The glide tracks 20 are press-fitted manually to the ribs 11. During such press-fitting, the glide tracks 20 snap into place after slight resilient yielding or opening. The recesses 13A are provided to assist in the fitting of the glide tracks by providing a location for one of the free edges of the C-shaped configuration. The nylon curtain runners 21 are fed into engagement with the glide tracks 20 in known manner and can slide the entire length of the curtain rail smoothly and quietly without causing irritating clicking noises despite the fact that the support rails are not themselves continuous.

The curtain rail described procures its advantages over previously proposed curtain rails at little extra manufacturing cost. Moreover, since the cross-sectional configurations of the support rail ribs and the glide tracks are generally mutually complementary so that the tracks embrace the ribs, the loading on the runners 21 subjects the glide tracks solely to compressive forces. Accordingly, the curtain loading is transmitted to the support rails 10 without any requirement for commensurate strength in the glide tracks. Eventual wear which may occur on the upper side of the glide tracks 20 can be countered by removing the tracks and re-fitting them reversed so that their previously downwardly presented sides are upwardly presented. During or after installation, the support rail assembly may incorporate relatively short lengths of support rail, for example for the purpose of correcting an error in sizing, without sacrificing the quiet-running and non-clicking feature of the described curtain rail.

Figure 4:
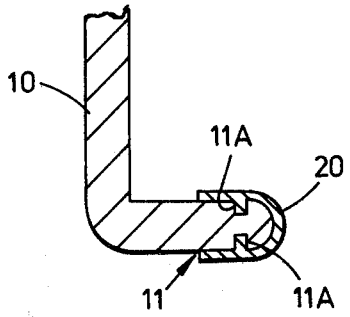
FIGS. 3 and 4 respectively illustrate, in sectional end elevation on the same scale as FIG. 2, two modifications of the cross-sectional configuration of part of the support rail and of the glide track seen in FIGS. 1 and 2, within the scope of the present invention.
Figure 3:
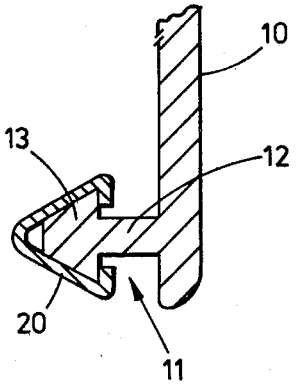

In FIGS. 3 and 4 of the drawings, two modifications of the above described curtain rail are shown respectively, and parts corresponding with those in FIGS. 1 and 2 are given the same reference numerals as are used in FIGS. 1 and 2. In FIG. 3, part of the cross sectional configuration of the support rail 10 defines a rib 11 comprising a web 12 and a bead 13 of trapezoidal configuration. A glide track 20 has a cross sectional configuration of triangular appearance which is generally complementary to that of the bead 13 and embraces the latter in a self-retaining manner as shown in FIG. 3. In FIG. 4, the support rail 10 incorporates a rib 11 in the form of the free edge portion of an inwardly directed flange at the mouth of the support rail 10. The upper and lower sides of the rib 11 in this case have grooves 11A, and the glide track 20 has complementary beads which are received in the grooves 11A. The manner of installation and operation of the curtain rail described with reference to FIGS. 1 and 2 applies also to the modifications described with reference to FIGS. 3 and 4.

It is envisaged that a curtain rail in accordance with the present invention may be assembled from a kit of parts including stock lengths of support rail material and stock lengths, preferably coiled, of glide track material sufficient to provide one-piece or continuous glide tracks on the total length of support rail material provided in the kit of parts. Accordingly, such a kit of parts is regarded as being within the scope of the present invention.

I claim:

1. A curtain rail comprising an assembly of a plurality of lengths of support rail, part of the cross-sectional configuration of each said length defining a pair of mutually parallel and mutually spaced longitudinal ribs which project laterally inwards of the support rail, and a pair of plastics glide tracks of a resiliently yieldable material each embracing a respective one of said ribs and each extending on all of the said lengths of said assembly so as to bridge all inter length joints, the cross-sectional configurations of the ribs and tracks being generally mutually complementary and the tracks being fitted to the assembly by press-fitting manually and self-retaining on the ribs.

2. A curtain rail according to claim 1, wherein the cross-sectional configuration of the ribs comprises a substantially circular portion, and the cross sectional configuration of the glide tracks is C-shaped.

3. A curtain rail according to claim 1, wherein the cross-sectional configuration of the support rail is generally of channel shape, and the said ribs are positioned adjacent the mouth of the channel shape.

4. A curtain rail according to claim 1 in combination with curtain runners for engagement with the glide tracks, each runner comprising upper and lower flange portions interconnected by a neck portion which extends in the gap between the glide tracks.

5. A curtain rail according to claim 1, wherein the glide track is made of polyvinylchloride.

6. A curtain rail according to claim 1, wherein the support rail is made of metal.

* * * * *